US006299548B1

(12) United States Patent
Lin

(10) Patent No.: US 6,299,548 B1
(45) Date of Patent: Oct. 9, 2001

(54) GOLF CLUB HEAD

(76) Inventor: Hui-Tsao Lin, No. 2, Lane 361, Tso-Ying-Ta Rd., Kaohsiung (TW)

( * ) Notice: Subject to any disclaimer, the term of this patent is extended or adjusted under 35 U.S.C. 154(b) by 0 days.

(21) Appl. No.: 09/382,788

(22) Filed: Aug. 25, 1999

(51) Int. Cl.[7] ..... A63B 53/04
(52) U.S. Cl. ..... 473/331; 473/349
(58) Field of Search ..... 473/324, 330, 473/331, 349, 350, 345, 342

(56) References Cited

U.S. PATENT DOCUMENTS 5,090,702 * 2/1992 Viste .
5,437,088 * 8/1995 Igarashi .
5,601,501 * 2/1997 Kobayashi .
5,611,742 * 3/1997 Kobayashi .
5,665,013 * 9/1997 Kobayashi .
5,676,605 * 10/1997 Kobayashi .
5,735,755 * 4/1998 Kobayashi .

* cited by examiner

*Primary Examiner*—Sebastiano Passaniti
(74) *Attorney, Agent, or Firm*—Birch, Stewart, Kolasch & Birch, LLP

(57) ABSTRACT

A strike face of a golf club head comprises a plurality of arched grooves formed by extending each pair of top edges respectively of two lateral walls in a groove on a back of each unit strike face between each pair of neighboring score lines in a strike face of a golf club head. In this way, the cutaway section on the back of the strike face looks like an arched bridge and the weight decrement of the arched grooves can be used for changing the center of gravity of the golf club head.

4 Claims, 2 Drawing Sheets

GOLF CLUB HEAD

BACKGROUND OF THE INVENTION

This invention relates to an improved strike face of a golf club head, wherein an arched back of the strike face may be used for adjusting the center of gravity of the club head according to weight decrement of the arched grooves.

As a plurality of scoring lines formed in the strike face of the club head is fluctuated, each flute bottom is the thinnest portion liable to be ruptured when striking (as shown in FIGS. 1 and 2).

For enhancing strength of the weakness, a reinforcement piece is usually provided with its protruded portions corresponding to the flute bottoms in a prior skill (FIG. 3) that moves substantially the center of gravity of the club head approaching the strike face, which requires to make other portions of the club, such as the strike face, the head, or the shaft coupling, thinner to keep the total weight of the club conforming to golfing regulations that will weaken its strength meanwhile.

In view of the above-described imperfection, the inventor has consequently developed and proposed this improved structure pertaining to the subject matter.

SUMMARY OF THE INVENTION

The right-angle grooves of the reinforcement piece on the back of the strike face in the prior art are substituted with arched grooves with better elasticity and strength, and moreover, the weight decrement of the arched grooves may be taken as a measure for changing the center of gravity of the club head for diversified designs.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

For a better understanding to the present invention, together with further advantages or features thereof, at least one preferred embodiment will be elucidated below with reference to the annexed drawings which are given by way of illustration only, and thus are not limitative of the present invention, and in which.

DETAILED DESCRIPTION OF THE PREFERRED EMBODIMENT

Figure 2:
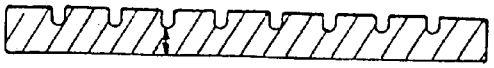
FIG. 2 PRIOR ART
FIG. 2 is a schematic cutaway sectional view of a strike face in the prior golf club head.
Figure 3:
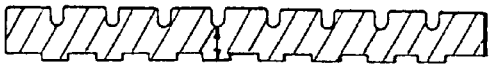
FIG. 3 PRIOR ART
FIG. 3 is a schematic cutaway sectional view of a strike face in another prior golf club head.
Figure 1:
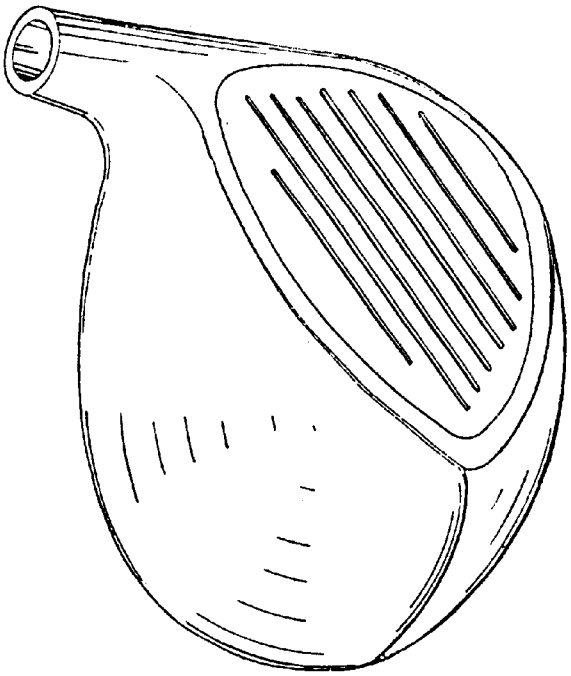
FIG. 1 PRIOR ART
FIG. 1 is a schematic three-dimensional view of a prior golf club head.
Figure 6:
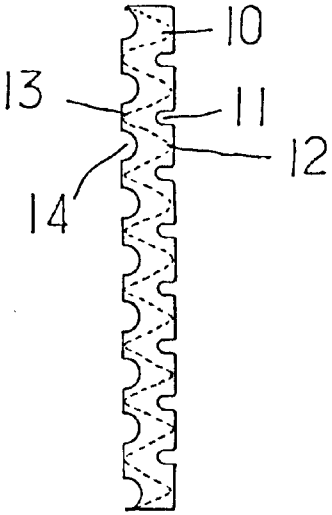
FIG. 6 is a schematic view showing structure of the strike face of the golf club head of this invention.
Figure 5:
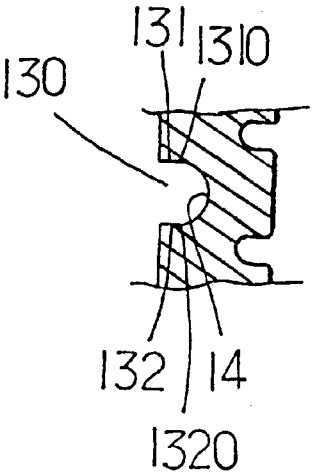
FIG. 5 is an enlarged view of an arched groove on back of the strike face of this invention.
Figure 4:
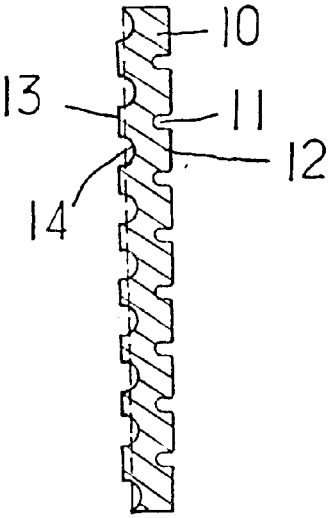
FIG. 4 is a schematic cutaway sectional view of a strike face of this invention.

As shown FIGS. 4 and 5, a plurality of arched grooves 14 is formed by extending each pair of top edges 1310, 1320 respectively of two lateral walls 131, 132 in a groove 130 on the back of each unit strike face 12 between each pair of neighboring score lines 11 in a strike face 10 of a golf club head of this invention, so that the cutaway section on the back of the strike face 10 looks like an arched bridge. Such a structure will not weaken the strike face 10, meanwhile, as the thickness between each unit strike face 12 and each arched groove 14 is thinned, the elasticity thereof is enhanced (as shown by dotted wave line in FIG. 6). Further, the weight decrement of the arched grooves 14 can be used to change the center of gravity of the golf club head for diversified designs and can be balanced by proper weight distribution to other parts of the golf club head, such as the strike face, the head, or the shaft coupling, etc.

The top edges 1310, 1320 form an arched top wall which is interconnected by the two lateral walls 131, 132. A circumference of one of the arched grooves 14 is larger than a circumference of one of the score lines 11.

The above-disclosed invention is made in a simple structure with excellent elasticity without weakening its strength to realize a more stable golf club head.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A strike face for a golf club head comprising a plurality of arched grooves, the grooves each having two opposed lateral walls and an arched top wall, the grooves being on a back of the strike face, a front of the strike facing having a plurality of score lines and the grooves being offset from the score lines such that in a cross-section of the face, neighboring score lines have one of the grooves therebetween, a weight decrement of the grooves changing a center of gravity of the golf club head, the two lateral walls of each groove being parallel and the arched top wall interconnects the two lateral walls of each groove wherein a circumference of one of the grooves is larger than a circumference of one of the score lines.

2. The strike face according to claim 1, wherein only one groove is between a pair of neighboring score lines in the cross-section of the face and wherein each pair of neighboring score lines have one groove therebetween.

3. The strike face according to claim 2, where spacing between the score lines is uniform and spacing between the grooves is uniform and wherein a zig-zag wave line can be formed between the front and back faces of the face in cross-section.

4. The strike face according to claim 2, wherein the two lateral walls of each groove are parallel.

* * * * *